US005939841A

United States Patent [19]

Román

[11] Patent Number: 5,939,841

[45] Date of Patent: Aug. 17, 1999

[54] METHOD AND APPARATUS USING A FLOATING ELECTRODE TO EXTRACT ENERGY FROM AN ELECTRIC FIELD

[76] Inventor: Francisco Román, Väktargatan 74A-111, 75422 Uppsala, Sweden

[21] Appl. No.: 08/741,702

[22] Filed: Oct. 31, 1996

[51] Int. Cl.[6] ..... H01T 19/00

[52] U.S. Cl. ..... 315/363; 315/76; 315/209 M; 361/231

[58] Field of Search ..... 361/231, 232, 361/233; 315/209 M, 363, 76

[56] References Cited

U.S. PATENT DOCUMENTS

| | | | |
|---|---|---|---|
| 1,697,177 | 1/1929 | Fortescue . | |
| 1,731,873 | 10/1929 | Smith . | |
| 2,140,395 | 12/1938 | Trencham et al. | 175/183 |
| 2,412,191 | 12/1946 | Zottu | 171/95 |
| 2,948,849 | 8/1960 | Foster | 324/54 |
| 4,935,657 | 6/1990 | Lherm et al. | 310/309 |
| 5,256,974 | 10/1993 | Padden | 324/458 |
| 5,293,113 | 3/1994 | Beha et al. | 324/72.5 |
| 5,300,889 | 4/1994 | Bakhoum | 324/457 |
| 5,587,868 | 12/1996 | Akutsu | 361/231 |

OTHER PUBLICATIONS

Feldman, P.L., AA. P.J. and Thanh, L.C., Present Status of Research–Cottrell Pulse Energization Technology, EPRI Conference on Electrostatic Precipitators Technology for Coal–Fired Power Plants, Nashville, Tennessee, Jul. 1982.

Francisco Román Campos, The Influence of a Floating Electrode on the Breakdown Voltage of a Complex Gap, Román, F.: UURIE 269–95 1, Institute of High Voltage Research, Uppsala University, 1995.

Francisco Román Campos, Vernon Cooray, and Viktor Scuka, Corona From Floating Electrodes, Journal of Electrostatics: Fundamentals, Applications and Hazards, Institute of High Voltage Research, Uppsala University, Husbyborg, S–752 28 Uppsala, Sweden, Oct. 1995.

Francisco Román Campos, Erik Lötberg, Rolf Högberg, and Vikor Scuka, Electrical Characteristics of Insulated Metallic Bodies in a Lightning Breakdown Field, Institute of High Voltage Research, Uppsala University, Sweden, 22nd International Conference on Lightning Protection, 1994.

Francisco Román Campos, Vernon Cooray and Vikor Scuka, The Corona Onset Voltage as a Function of the Radius of Curvature of Floating Electrodes, The Eleventh International Conference on Gas Discharges and Their Applications, Chuo University, Tokyo, Sep. 11–15, 1995.

Francisco Román Campos and Vikor Scuka, The Influence of a Series Micro–Gap on the Breakdown Voltage Reduction of a Complex Gap Arrangement Containing Floating Electrodes, FE, Ninth International Symposium of High Voltage Engineering, Aug. 28–Sep. 1, 1995, Graz Convention Center, Austria, Europe.

*Primary Examiner*—Don Wong
*Assistant Examiner*—David H. Vu
*Attorney, Agent, or Firm*—Jenkens & Gilchrist, P.C.

[57] ABSTRACT

The device disclosed herein relates to an apparatus for obtaining energy from an electric field. The apparatus has a floating electrode connected to a series gap device. The floating electrode is adapted to convert the energy found in an electric field into usable electric energy. The usable electric energy can be stored in an electric storage device.

13 Claims, 3 Drawing Sheets

METHOD AND APPARATUS USING A FLOATING ELECTRODE TO EXTRACT ENERGY FROM AN ELECTRIC FIELD

BACKGROUND OF THE INVENTION

1. Field of the Invention

The present invention relates to coupling an electric energy storage device to an electric field using the corona discharges from a floating electrode. The corona ionic currents are used to charge the electric energy storage device.

2. Description of the Related Art

Floating electrodes are metallic objects that are disconnected from earth potential, and which, under certain well-defined conditions, can acquire an electric potential. The electric potential can be increased if a floating electrode has corona sources on its surface. Thus, a floating electrode can accumulate potential energy. The potential level and the amount of potential energy that a floating electrode acquires is a direct function of the electrodes area and a gap distance to an earth potential or a lower potential.

It would be useful to harness the potential energy that a floating electrode accumulates.

SUMMARY OF THE INVENTION

The present invention relates to a device that incorporates a floating electrode and a parallel gap device to harness electrical energy found in an electric field.

Energy from an electric field is coupled to a storage device by taking advantage of the corona currents created in the sharp points (high curvature areas) of a floating electrode. The corona currents are conducted to a storage device. A gap is connected in series with the floating electrode, but in parallel to the electric storage device, in order to protect the storage device against overvoltages and overcharging. The series gap defines the voltage level of the floating electrode.

BRIEF DESCRIPTION OF THE DRAWINGS

These and other objects and advantages of this invention will become apparent and more readily appreciated from the following description taken in conjunction with the accompanying drawings of which.

DETAILED DESCRIPTION OF THE PREFERRED EXEMPLARY EMBODIMENTS OF THE PRESENT INVENTION

Although a few preferred embodiments of the invention are shown and described, it will be appreciated by those skilled in the art that changes may be made in these embodiments without departing from the principles and the spirit of the invention.

A metallic body, such as an electrode of any type, can be subjected to the effects of a background electric field. If a plurality of sharp metallic points are associated with the electrode, the electric field can be amplified at the electrode surface. When and if the amplified electric field reaches a critical field, that is, an electric field strong enough for the onset of corona currents, the air becomes ionized and the ionic currents begin to flow between the air and the metallic electrode. The present invention is adapted to store the ionic currents in a conventional electrical energy storage device such as capacitors or accumulators.

The present invention is based on the principle of a floating electrode terminated into a multi-needled floating electrode wherein each needle acts as a separate corona source. The floating electrode is adjacent to an earthed electrode. An electric energy accumulator is adapted to accumulate energy established on the floating electrode. The corona onset voltage of the multi-needled electrode can be controlled by changing its length and/or the number of needles or branches associated with the electrode.

Electrically charged particles in an electric field can gain energy. Additionally, electric fields are intensified in the low curvature areas of conducting surfaces (the sharp points). In the low curvature of a floating electrode areas corona discharges can be initiated and ionic currents can be established. The ionic currents can be stored as electrical energy in electric energy accumulators.

Figure 1:
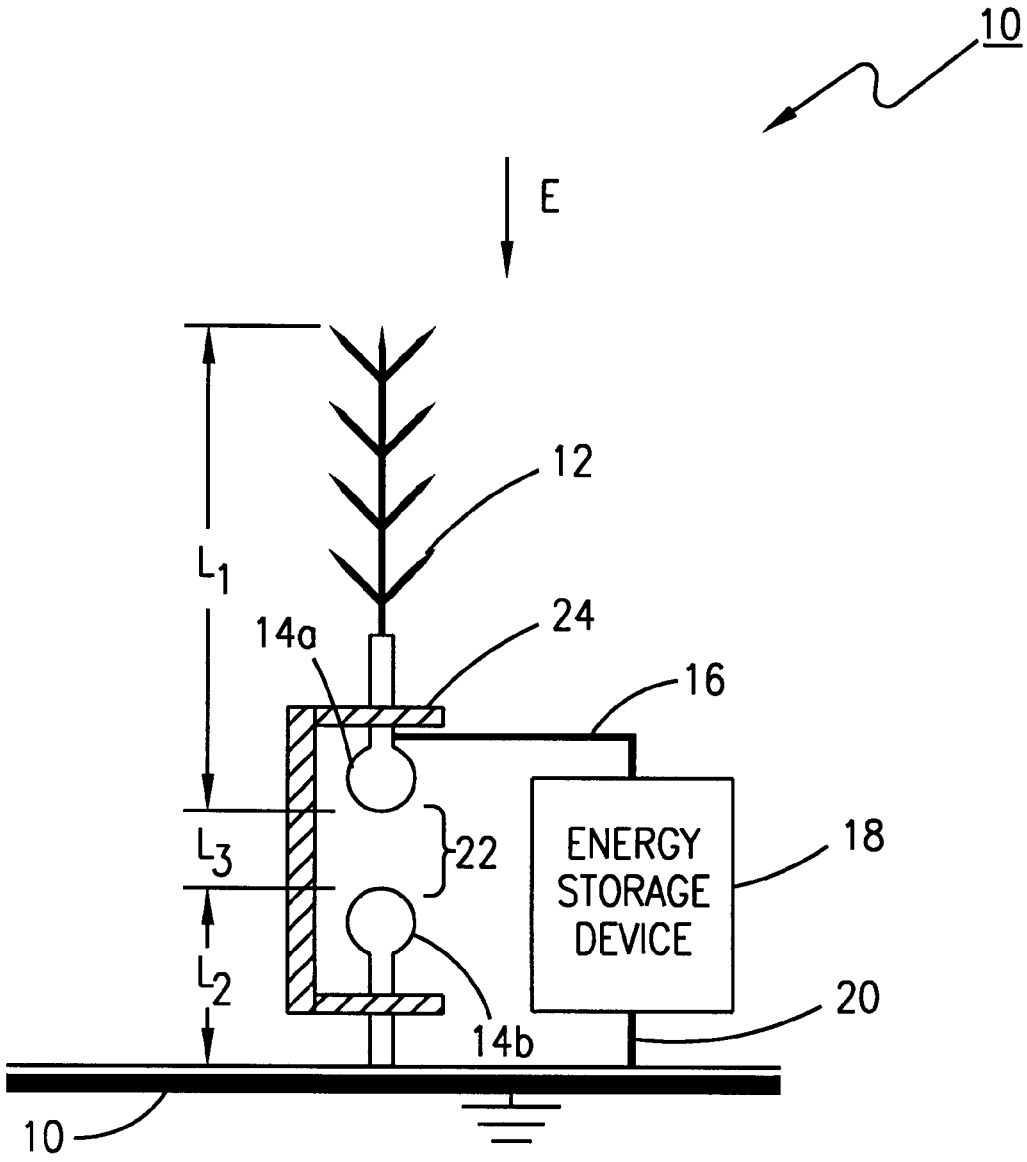
FIG. 1 depicts an exemplary embodiment of a device that extracts energy from an electric field and stores the extracted energy.

FIG. 1 depicts an exemplary device 10 for obtaining energy from a background electric field E. A floating electrode 12 extends from the device. The floating electrode can be a single needle type or any type of floating electrode, but preferably comprises a plurality of pointed or wire-like extensions from the electrode base. The pointed or wire-like extensions are the corona sources.

When the background field E is strong enough to establish corona onset voltages in the sharp tips of the wire-like extension of the floating electrode 12, then an ionic current will flow from the ionized air through the floating electrode 12 and to the sphere 14*a*. The current is then conducted via conductor 16 to an energy storage device 18. The storage device 18 is grounded via connection 20.

The sphere 14*b* and its supporting rod is also grounded. The two spheres 14*a* and 14*b* form a parallel gap 22. It is understood that the spheres 14*a* and 14*b* can be different diameters and/or be made of different conducting materials. The spheres can also be other shapes besides a sphere, in fact, the shapes could be plates, ovals, egg shapes, or vast variety of non-uniform shapes.

The gap 22 is used to control the maximum charging of the energy storage device 18 and also to fix the potential of the floating electrode. The gap 22 can be described as having a predetermined distance from sphere 14*a* to sphere 14*b*. A support 24, which is constructed from a non-conducting material, keeps the floating electrode in a fixed position. The support can also be used to adjust the gap distance 22. The distance $L_3$, $L_2$, or $L_1$ can be changed to thereby be adapted to the available amplitude of the electric field.

The present invention can also have an enclosure (not shown) about the spheres 14*a* and 14*b* such that a gas or fluid can be contained therein to enhance the charging and/or discharging properties of the gap. The support 24 can be used to encase a series gap 22 from ambient conditions. The enclosure can be incorporated into the support 24.

Figure 2:
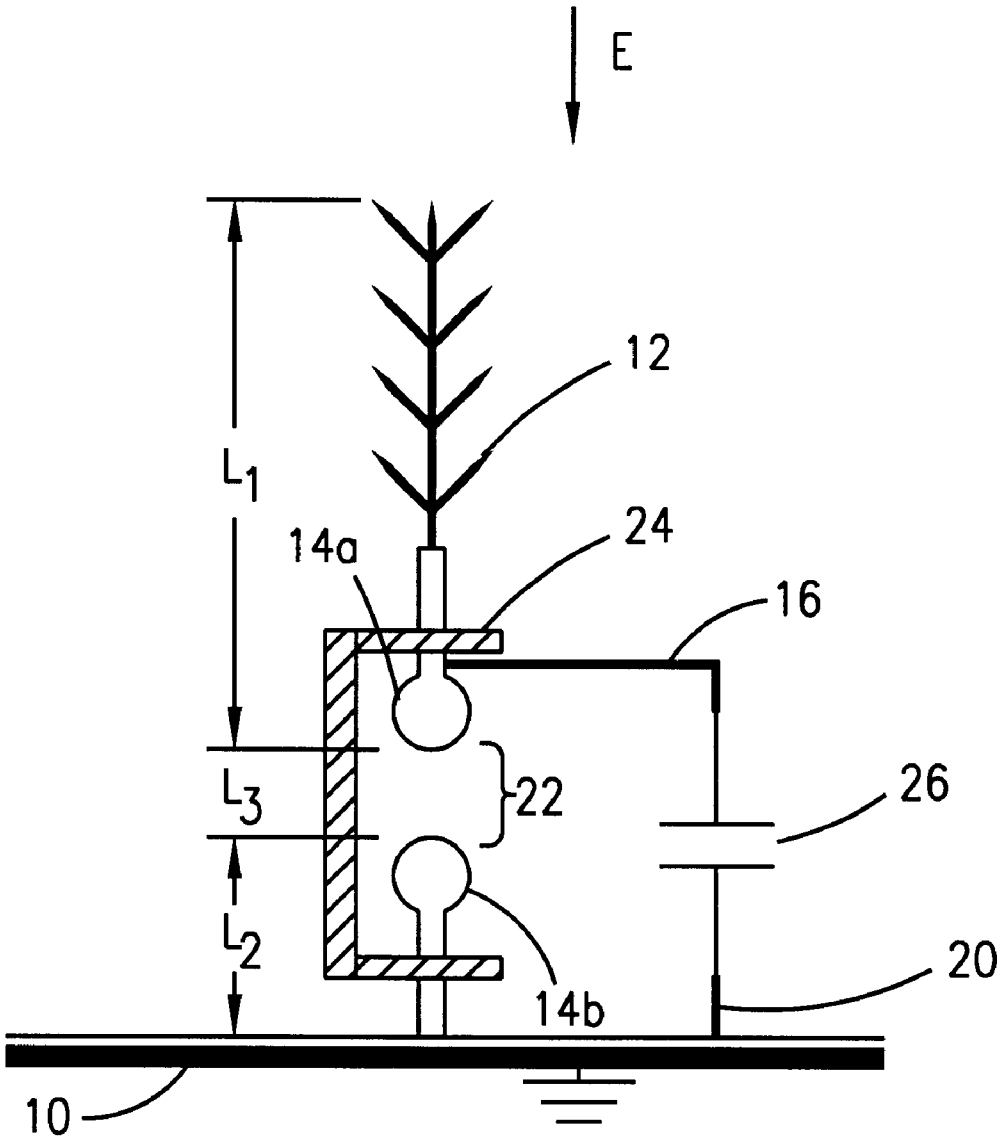
FIG. 2 depicts a second exemplary embodiment of a device that extracts energy from an electric field and stores the extracted energy.

FIG. 2 depicts another exemplary embodiment of the present invention. This embodiment is very similar to the embodiment disclosed in FIG. 1. One difference is a capacitor 26 is being used as the electrical energy storage device.

Figure 3:
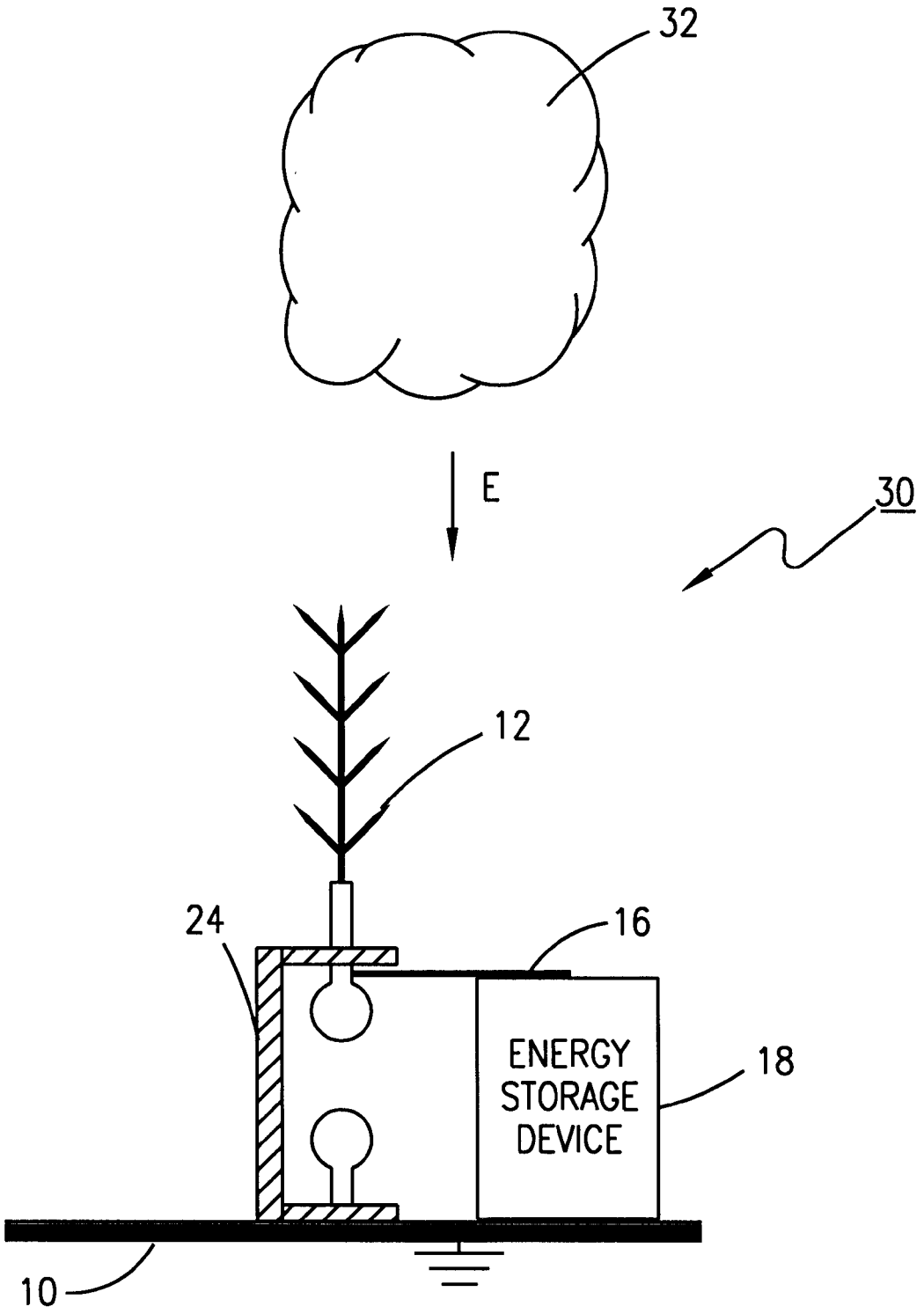
FIG. 3 depicts a third exemplary embodiment of a device that extracts energy from an electric field and stores the extracted energy.

FIG. 3 depicts an exemplary embodiment of the present invention and its principle of operation. The exemplary device 30 is being used to charge an energy storage device 18 when the electric energy source is established via the background electric field produced by a thunder-storm cloud 32. It is understood that the present invention does not obtain its energy from lightning strikes, but instead the electric fields found in the atmosphere. Knowing that atmospheric electric fields change their polarity, the exemplary device described may be provided with a rectifier circuit/system to block the currents of the opposite polarity. The rectifying system is not specifically shown in the drawings, but one of ordinary skill in the art would understand how to include one in the exemplary invention.

It is foreseen that other electronics may be connected to the present invention to protect it from high voltage strikes. Furthermore, various electric configurations can be connected to the present invention in order to extract the useful energy that has been stored in the storage device 18. It is also understood that corona currents have different polarities. The polarity of the corona currents depend on the voltage source. Thus, rectifying circuits/systems are required to block the opposite polarity currents.

As stated earlier, the present invention can provide a means for extracting energy from background electric fields found in normal atmospheric conditions. As is clearly seen, the present invention provides a simple and inexpensive technique for extracting formerly unusable energy and creating useful energy. The present invention is believed to be especially effective when configured and employed as described herein, however, those skilled in the art will readily recognize that numerous variations and substitutions may be made in the invention, its use, and configuration to achieve substantially the same results as achieved by the disclosed embodiments. Each variation is intended to be included in the description and forms a part of the present invention. The foregoing detailed description is, thus, to be clearly understood as being given by way of illustration and exemplary only, the spirit and scope of the present invention being limited by the appended claims.

What is claimed is:

1. An apparatus for obtaining electric energy from an electric field, comprising:

a floating electrode having a plurality of points for placement in a electric field and amplification of said electric field;

a first protective conductive means, connected to said floating electrode, for discharging a voltage;

a second protective conductive means, spaced a predetermined distance from said first protective conductive means; and an electric energy storage device connected to said first protective conductive means for storing energy obtained from said electric field wherein said second protective conductive means operates to prevent overcharging said electric energy storage device by discharging said first protective conductive means when the potential difference between said first and second means reaches the value of said voltage.

2. The apparatus of claim 1, wherein said first conductive means and said second conductive means are spherical.

3. The apparatus of claim 1, further comprising an enclosure which encases said first conductive means and said second conductive means.

4. The apparatus of claim 3, wherein said enclosure is filled with at least one of a gas and a liquid.

5. The apparatus of claim 1, wherein said electric storage device comprises an accumulator.

6. The apparatus of claim 1, wherein said electric storage device comprises a capacitor.

7. The apparatus of claim 1, further comprising a rectification circuit connected between said first conductive means and said electric energy storage device.

8. An apparatus for obtaining electric energy from an electric field, comprising:

a floating electrode comprising a plurality of sharp points extending therefrom, said electrode being adapted to amplify an electric field;

an electric energy storage device connected to said floating electrode for storing energy from said electric field;

a first protective conductive means, connected to said floating electrode, for discharging a voltage; and a second protective conductive means, spaced a predetermined distance from said first protective conductive means.

9. The apparatus of claim 8, wherein said electric energy storage device comprises a rectification system.

10. A method of obtaining electricity from an electric field, comprising the steps of:

amplifying said electric field near a floating electrode having a plurality of points;

generating ionic currents due to said amplified electric field;

conducting said ionic currents such that an electric storage device is charged; and protectively discharging a first protective conductive means using a second protective conductive means to prevent overcharging of said electric storage device.

11. The method of claim 10, wherein said amplifying step occurs in a floating electrode.

12. The method of claim 10, wherein said floating electrode comprises a plurality of sharp points.

13. The method of claim 10, wherein said ionic currents are provided to an electric circuit.

* * * * *